US006186666B1

(12) United States Patent
Stahlecker

(10) Patent No.: US 6,186,666 B1
(45) Date of Patent: Feb. 13, 2001

(54) RING SPINDLE AND PROCESS FOR LUBRICATING SAME

(75) Inventor: Gerd Stahlecker, Eislingen/Fils (DE)

(73) Assignee: Novibra GmbH, Suessen (DE)

( * ) Notice: Under 35 U.S.C. 154(b), the term of this patent shall be extended for 0 days.

(21) Appl. No.: 09/388,197

(22) Filed: Sep. 1, 1999

(30) Foreign Application Priority Data

Sep. 9, 1998 (DE) ..... 198 41 088
Feb. 19, 1999 (DE) ..... 199 07 162

(51) Int. Cl.[7] ..... F16C 33/66; D01H 7/12; D01H 7/20

(52) U.S. Cl. ..... 384/241; 57/134; 184/103.1; 384/227; 384/322; 384/239

(58) Field of Search ..... 384/227, 241, 384/322, 397, 398, 239; 57/133, 134, 135; 184/103.1

(56) References Cited

U.S. PATENT DOCUMENTS 264,297 * 9/1882 Jaquith ..... 57/134
887,162 * 5/1908 Westcott et al. ..... 384/241
1,745,112 * 1/1930 Nainteau ..... 384/241
2,499,075 * 2/1950 Robinson et al. ..... 384/241
4,796,419 * 1/1989 Braxmeier ..... 57/134

OTHER PUBLICATIONS

Suessen–Novibra Technical Information leaflet SO6/6411D. No date.

* cited by examiner

*Primary Examiner*—Thomas R. Hannon
(74) *Attorney, Agent, or Firm*—Evenson, McKeown, Edwards & Lenahan, P.L.L.C.

(57) ABSTRACT

A ring spindle assembly and process for re-lubricating a ring spindle having a vertically arranged bearing housing with a closed bottom. A step bearing is arranged in an oil-bath of the bearing housing for a rotating shaft. In the bearing housing, at least two lubricating channels are provided above the desired oil level of the oil-bath. When the shaft remains in the bearing housing, oil is filled into one lubricating channel until oil comes out of the other lubricating channel. A certain amount of oil is subsequently sucked out through the lubricating channel, so that the oil reaches the desired level.

14 Claims, 2 Drawing Sheets

RING SPINDLE AND PROCESS FOR LUBRICATING SAME

BACKGROUND AND SUMMARY OF THE INVENTION

This application claims the priority of German application 198 41 088.3 filed in Germany on Sep. 9, 1998, and German application 199 07 162.4 filed in Germany on Feb. 19, 1999, the disclosures of which are expressly incorporated by reference herein.

The present invention relates to a ring spindle comprising a vertically arranged bearing housing having a closed bottom, and a step bearing arranged in an oil-bath of the bearing housing for a rotating shaft.

In the case of such ring spindles it has been shown that the oil itself remains clear and free of impurities even after many years of use. Re-lubrication is only then necessary because too much oil has leaked out of the bearing housing. In the usual re-lubrication process, the shaft is removed from the bearing housing, so that oil can be filled into the bearing housing by means of an injection pistol. This is described, for example, in the Suessen-Novibra Technical Information leaflet S06/6411 D. There is always the risk that in the spinning mill, fly and trash can get into the bearing housing. In addition, it is not ensured that the shaft is re-inserted into the same bearing housing again.

It is an object of the present invention to produce a ring spindle whereby oil can be refilled without the shaft being removed from the bearing housing.

This object has been achieved in accordance with the present invention in that two lubricating channels having narrow cross sections are applied in the bearing housing above the desired oil level of the oil-bath.

Oil can be re-filled by means of one of these lubricating channels, without the shaft having to be removed from the bearing housing, whereby the lubricating process can, if required, take place even when the ring spindle is operating. As it is not known exactly how much oil should be re-filled, as the oil level differs from ring spindle to ring spindle after a certain amount of time, at least so much oil is re-filled until again runs out of the other lubricating channel. This ensures that a definite amount of oil is present in the bearing housing.

In a further step, a definite amount of oil is sucked out of the bearing housing, namely just enough so that the desired oil level is reached.

The bearing housing comprises advantageously a tube which comprises the bottom, and also a bearing head inserted by means of a press fit into the tube and taking up a neck bearing, which bearing head is provided in the area of the press fit with longitudinal grooves belonging to the lubricating channels. The lower ends of the longitudinal grooves are disposed for the purpose at the desired oil level, while radial through holes of the tube are advantageously arranged at the upper end of the longitudinal grooves. These countersunk through holes can be filled out with plastic inserts, which are provided with very narrow radial oil bore holes. This prevents trash and fly from penetrating into the lubricating channels and thus from penetrating into the bearing housing.

As far as it is required in further embodiments of the present invention not only to refill oil but further to wash old oil out, it can be provided that beneath the bearing head, directly adjacent thereto, an intermediary tube, preferably made of plastic, is inserted into the tube of the bearing housing, which intermediary tube is provided with a longitudinal channel extending one of the longitudinal grooves, which longitudinal channel extends to the area of the step bearing.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figures 1, 2:
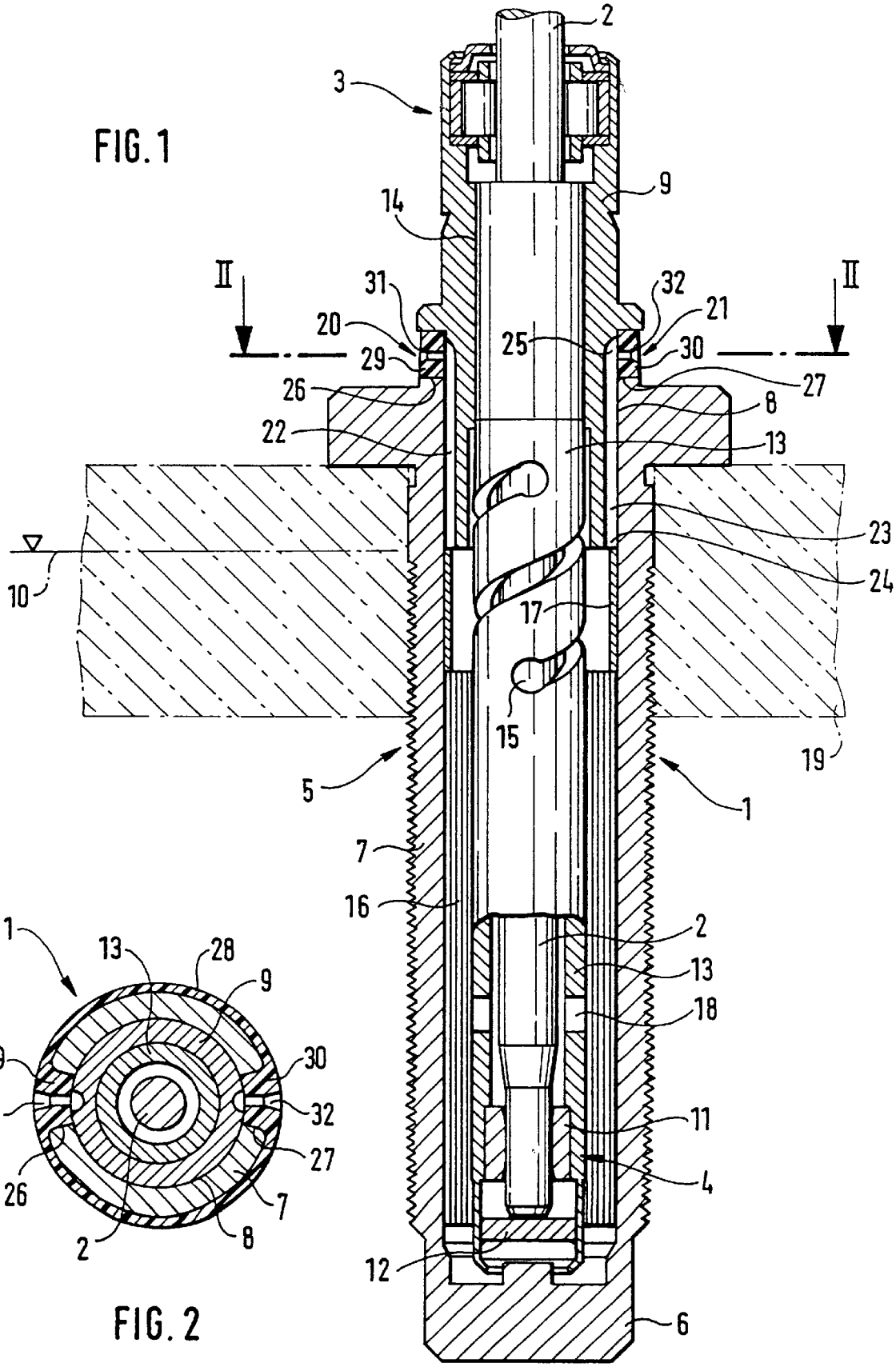
FIG. 1 is a longitudinal sectional view through a ring spindle constructed according to a preferred embodiment of the present invention.
FIG. 2 is a sectional view along the section II—II of FIG. 1.

The vertically arranged ring spindle 1 according to the present invention comprises a shaft 2 driven to rotate, which shaft 2 is supported in a neck bearing 3 in the form of a roller bearing and also in a two-part step bearing 4. The neck bearing 3 and the step bearing 4 are located in a bearing housing 5, which comprises a closed bottom 6.

The bearing housing 5 consists essentially of a tube 7 comprising the bottom 6, as well as a bearing head 9 which takes up the neck bearing 3, which bearing head 9 is inserted by means of a press fit 8 into the tube 7. In the inside of the bearing housing 5, an oil-bath is located in the area of the step bearing 4, the level of which oil-bath is denoted by the reference number 10.

The step bearing 4 comprises a step bearing tube 11 which takes up the radial forces, and also comprises a thrust plate which takes up the axial forces. The step bearing tube 11 is supported in a centering tube 13, which in turn is affixed in the bearing head 9 by means of a press fit 14. The centering tube 13 comprises a helical-shaped recess 15, which makes the centering tube 13 flexibly bendable to a desired degree.

Between the cylindrical inner contour of the tube 7 and the cylindrical outer contour of the centering tube 13, an annular gap is located, which takes up an oil spiral 16 in a known way. The oil spiral 16 is arranged entirely in the oil-bath. By means of transverse bore holes 18 in the centering tube 13, the annular space containing the oil spiral 16 is in contact with the oil-bath of the step bearing 4. The oil spiral 16 is supported upwards by means ~f a distance tube 17.

The ring spindle 1, together with a plurality of further adjacently arranged ring spindles, is affixed in a known way to a spindle rail 19, denoted only by a dot-dash line. At the ring spindle 1 a drive wharve (not shown) is further arranged, whereby all drive wharves are driven by a continuous drive belt extending in machine longitudinal direction.

During operation, oil is lost from the oil-bath, although the oil itself is still in perfect condition for lubricating even after a long usage time. In any case, oil must be re-filled in the bearing housing 5 after a certain operational time. In order that, as was usual up to now, the shaft 2 does not have to be removed upwards out of the bearing housing 5, the ring spindle 1, in accordance with the present invention, is to be relubricated while the shaft 2 is located in the bearing housing 5. The ring spindle 1 may even continue to run thereby.

According to the present invention, at least two lubricating channels 20 and 21 are provided in the tube 7 of the bearing housing 5 above the desired level 10 of oil of the oilbath. These lubricating channels 20,21 each comprise longitudinal grooves 22 and 23, which are located at the outer periphery of the bearing head 9. As the bearing head 9 is inserted by means of a press fit 8 into the tube 7, closed longitudinal grooves 22,23 of the lubricating channels 20,21 are provided all around.

The lower end 24 of the longitudinal grooves 22,23 is located approximately at the desired oil level 10 of the oil-bath. The upper end 25 of the longitudinal grooves 22 and 23 is disposed above the spindle rail 19. There, where the longitudinal grooves 22 and 23 enter into the tube 7, the tube 7 is countersunk to such an extent that through holes 26 and 27 arise therein. These through holes 26 and 27 are filled out with plastic inserts 29 and 30, which in turn have very narrow radial cross bore holes 31 and 32. The plastic inserts 29 and 30 can be a component of a plastic ring 28 slid over the bearing housing 5.

The ring spindle 1 described can be re-lubricated with oil, without the shaft 2 having to be removed from the bearing housing 5. It is not certain exactly how much oil has to be added, as the oil level varies after a certain amount of time from ring spindle 1 to ring spindle 1. Consequently, the following procedure is applied for re-lubricating:

The oil is filled into the bearing housing 5 by means of a lubricating channel 20 until it runs out again by means of the other lubricating channel 21. This ensures that in any case a certain amount of oil is present in the bearing housing 5. In a further procedural step, a certain amount of oil is suctioned out of the bearing housing 5 until the desired level 10 is reached. This whole process can take place while the ring spinning machine is operational.

Figure 3:
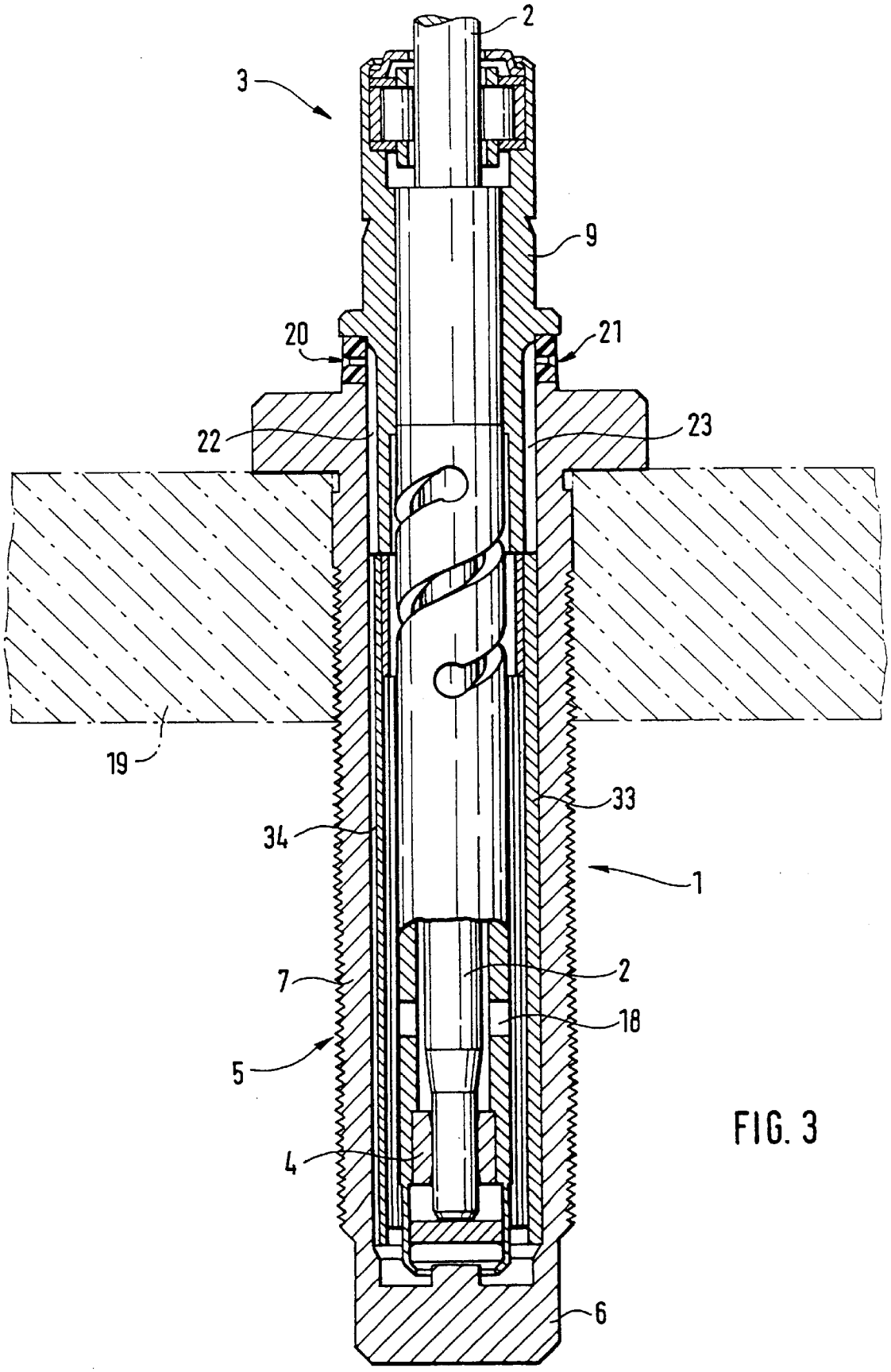
FIG. 3 is a longitudinal sectional view through a ring spindle constructed according to another embodiment of the present invention.

In the variation according to FIG. 3, a plastic intermediary tube 33 is inserted into the tube 7 below the bearing head 9 directly adjacent thereto. This intermediary tube 33 comprises a longitudinal channel 34, which extends the longitudinal groove 22 and which extends to the area of the step bearing 4. Thus during refilling with new oil, old oil can be washed out by means of the other longitudinal groove 23.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A ring spindle comprising:

a vertically arranged bearing housing having a closed bottom, and a step bearing arranged in an oil-bath of the bearing housing for a rotating shaft, wherein above a desired oil level of the oil-bath, at least two lubricating channels having narrow cross sections are arranged in the bearing housing.

2. A ring spindle according to claim 1, wherein the bearing housing comprises a tube comprising the bottom, and a bearing head inserted by means of a press fit into the tube, said bearing head taking up a neck bearing, said bearing head being provided in the area of the press fit with longitudinal grooves arranged at said lubricating channels.

3. A ring spindle according to claim 2, wherein an intermediary tube is inserted into the tube below the bearing head directly adjacent thereto, which intermediary tube is provided with a longitudinal channel extending a longitudinal groove, which longitudinal channel extends to the area of the step bearing.

4. A ring spindle according to claim 2, wherein lower ends of the longitudinal grooves are disposed at the desired oil level.

5. A ring spindle according to claim 4, wherein a intermediary tube is inserted into the tube below the bearing head directly adjacent thereto, which intermediary tube is provided with a longitudinal channel extending a longitudinal groove, which longitudinal channel extends to the area of the step bearing.

6. A ring spindle according to claim 4, wherein radial through holes of the tube are arranged at the upper end of the longitudinal grooves.

7. A ring spindle according to claim 6, wherein the through holes are filled out with plastic inserts, which are provided with narrow radial oil bore holes.

8. A ring spindle according to claim 2, wherein radia through holes of the tube are arranged at the upper end of the longitudinal grooves.

9. A ring spindle according to claim 8, wherein an intermediary tube is inserted into the tube below the bearing head directly adjacent thereto, which intermediary tube is provided with a longitudinal channel extending a longitudinal groove, which longitudinal channel extends to the area of the step bearing.

10. A ring spindle according to claim 8, wherein the through holes are filled out with plastic inserts, which are provided with narrow radial oil bore holes.

11. A ring spindle according to claim 10, wherein an intermediary tube is inserted into the tube below the bearing head directly adjacent thereto, which intermediary tube is provided with a longitudinal channel extending a longitudinal groove, which longitudinal channel extends to the area of the step bearing.

12. A method of lubricating the ring spindle according to claim 1, by supplying oil to one of said lubricating channels until oil flows out of the other of said lubricating channels.

13. A process for re-lubricating a ring spindle having a vertically arranged bearing housing with a closed bottom and a step bearing arranged in an oil-bath of the bearing housing for a rotating shaft, wherein while the shaft remains in the bearing housing, oil is filled in through a lubricating channel located above a desired level of the oil at least until oil runs out again through another lubricating channel located at the same level.

14. A process according to claim 13, wherein a certain amount of oil is suctioned off through the lubricating channel so that the desired level of oil is achieved.

* * * * *